US007866008B2

(12) United States Patent
Laks

(10) Patent No.: US 7,866,008 B2
(45) Date of Patent: Jan. 11, 2011

(54) ADJUSTABLE FASTENER FOR FOOT APPAREL

(75) Inventor: David Allen Laks, Vista, CA (US)

(73) Assignee: Fotofeet, Inc., Vista, CA (US)

( * ) Notice: Subject to any disclaimer, the term of this patent is extended or adjusted under 35 U.S.C. 154(b) by 1002 days.

(21) Appl. No.: 11/655,336

(22) Filed: Jan. 19, 2007

(65) Prior Publication Data

US 2007/0234523 A1 Oct. 11, 2007

Related U.S. Application Data

(60) Provisional application No. 60/760,801, filed on Jan. 19, 2006.

(51) Int. Cl.
*A43C 11/00* (2006.01)
*A44B 11/26* (2006.01)

(52) U.S. Cl. ..... 24/68 SK; 24/614; 24/615

(58) Field of Classification Search ..... 24/68 SK, 24/69 SK, 70 SK, 71 SK, 614–616, 625, 24/DIG. 43–DIG. 48, 591.1, 593.1–596.1
See application file for complete search history.

(56) References Cited

U.S. PATENT DOCUMENTS 3,662,435 A * 5/1972 Allsop ..... 24/70 SK
4,727,630 A * 3/1988 Alan ..... 24/593.11
4,907,352 A * 3/1990 Ginsberg ..... 36/50.1
D323,576 S * 2/1992 Laks ..... D11/200
5,778,498 A * 7/1998 Laks ..... 24/625
6,568,104 B2 * 5/2003 Liu ..... 36/50.1
6,691,433 B2 * 2/2004 Liu ..... 36/50.1

* cited by examiner

*Primary Examiner*—Robert J Sandy
(74) *Attorney, Agent, or Firm*—Mintz, Levin, Cohn, Ferris, Glovsky and Popeo, P.C.

(57) ABSTRACT

A latching mechanism for securing foot apparel to a user's foot. The latching mechanism comprises a first connecting member, a second connecting member, wherein the first connecting member is capable of mating, or interlocking, with the second connecting member. The first connecting member includes a receiving head having an aperture, and an arm, wherein the arm is adjacent the receiving head and the second connecting member includes a locking tongue and an arm, wherein the arm is adjacent the locking tongue. In some embodiments, the first connecting member and second connecting member include a fastener element. The arm of the first connecting member and the arm of the second connecting member further include an aperture that is capable of receiving a securing mechanism. Additional embodiments of the latching mechanism also include a buckle system including a base having complementary sections capable of mating and being laterally adjustable, a button which actuates a floating locking mechanism, and a dome.

19 Claims, 22 Drawing Sheets

ADJUSTABLE FASTENER FOR FOOT APPAREL

CROSS REFERENCE TO RELATED APPLICATION

The present patent application claims priority under 35 U.S.C. §119 to U.S. Provisional Patent Application Ser. No. 60/760,801, filed on Jan. 19, 2006, and entitled, "ADJUSTABLE FASTENER FOR FOOT APPAREL", the entire disclosure of which is incorporated by reference herein.

BACKGROUND

This application generally relates to an apparatus for comfortably securing foot apparel to a user's foot without the necessity of securing the foot apparel to the user's foot with conventional laces.

Recreational shoes, such as tennis shoes, are becoming increasingly more popular as society becomes more relaxed and less formal in its interactions. Indeed, it is not surprising to find many company personnel dressed in tennis shoes while at work as opposed to the more traditional formal shoes, such as men's dress shoes or women's high heels.

In general, young children, overweight or elderly people find it inconvenient, or difficult, to bend over and tie their shoes. Thus, efforts have been made to transform the recreational shoe into a "loafer" wherein the user need not tie the shoe with a conventional shoe lace, but rather, can simply slip the shoe onto their foot or quickly secure the shoes with a single snap.

U.S. Pat. No. D323,576 to Laks shows an adjustable latch having a sawtooth mating structure for closing a shoe, wherein the latch attaches to the shoe via hooking elements. In this design, the hooking elements attach to the eyelets of the shoe. This design can present various problems. For instance, the hooking elements are not relatively flush with the underside of the eyelets and thus, press down against the user's foot and cause discomfort to the user. This problem occurs because the hooking elements, which are somewhat bulky in nature, protrude below the eyelet and are drawn close to the foot when the latch is buckled to secure the foot apparel onto the foot. Further, the sawtooth design creates a more difficult closure and release of the latch, especially for persons with limited dexterity, such as, aged persons and young children.

As seen from above, current attempts at creating a tie-less shoe have resulted in a diminishment of the comfort of the shoe. Thus, a need exists in the market to create an apparatus to allow the tie on the shoe to be circumvented, but not detract from the comfort of the recreational shoe.

SUMMARY

Disclosed is a buckle device that is configured to adjustably fasten two components to one another. The buckle device is described herein in the context of being used for securing together components of a shoe for securing the shoe to a user's foot. However, it should be appreciated that the buckle device is suitable for use with other components that adjustably fasten to one another. For example, the buckle device can be used on a hat for adjustably tightening and securing a hat around a user's head. The buckle device can be used on gloves for adjustably tightening and securing a glove to a user's wrist. The buckle device can be used on a belt for trousers for adjustably tightening the waistband and securing trousers around a user's waist. Other uses for the buckle device are within the scope of this disclosure.

Among the embodiments disclosed herein is a buckle for securing footwear to a user's foot, wherein the footwear includes an instep having a plurality of eyelets, the buckle including a base, a button and a plurality of rivets. The base includes a female portion and a male portion. The female portion includes an attachment member and a slot. The male portion includes a flexible belt sized to fit within the slot of the female portion such that the portions are laterally adjustable across an axis perpendicular to the instep. The button is configured to slideably actuate across the attachment member and compress the attachment member against the belt. The plurality of rivets is configured to insert through eyelets and into apertures of the female and male portions of the base. At least one rivet is configured to insert through an eyelet and into the apertures of the female portion and at least one rivet is configured to insert through an opposing eyelet into the aperture of the male portion to attach the base and, in turn the buckle, to the footwear.

The attachment member can comprise a plank that is upwardly biased. The female portion further includes a belt guide which provides upward resistance against the belt upon downward compression of the belt by the plank. The plank can comprise a tab and a lip on its upper surface. The button can comprise a catch on its underneath surface which can engage the lip upon actuation of the button. The button can further comprise a notch located on an underneath surface of the button such that upon actuation of the button the tab on the plank snaps down into the notch of the button. The rivets each comprise a post and a foot. The post can comprise a flange. The post can also be split into at least two flared segments. The buckle can further comprise a dome. The button can also comprise a stage on its upper surface and the dome can cover the stage of the button. The buckle can further comprise a light-emitting diode which can be activated upon actuation of the button.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1A:
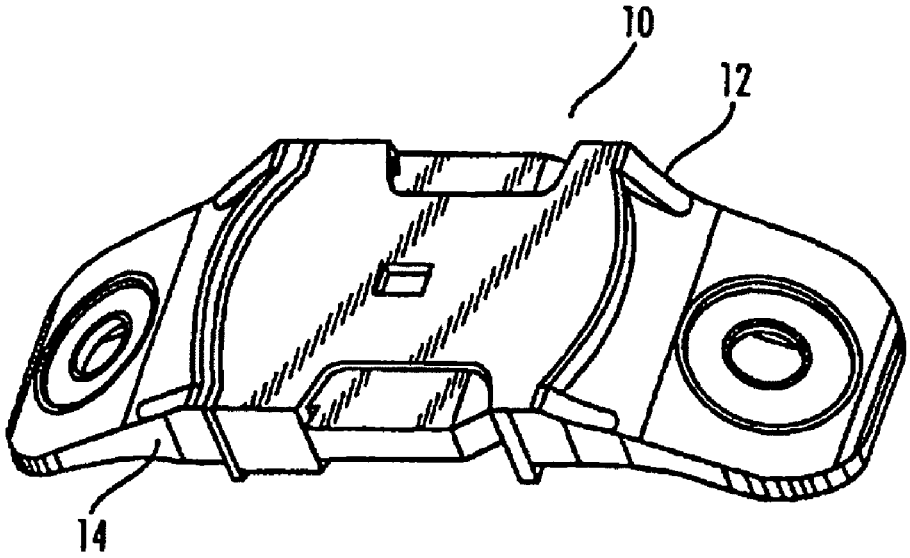
FIG. 1*a* is a top perspective view of a releasable fastener, wherein the latching element is in a locked, or closed, position.
Figure 1B:
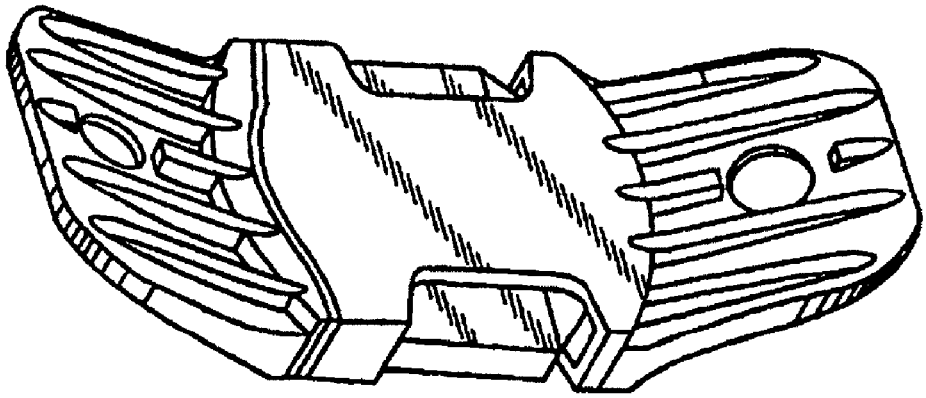
FIG. 1b Prior art
FIG. 1*b* is a bottom perspective view of the releasable fastener depicted in FIG. 1*a*.
Figure 2:
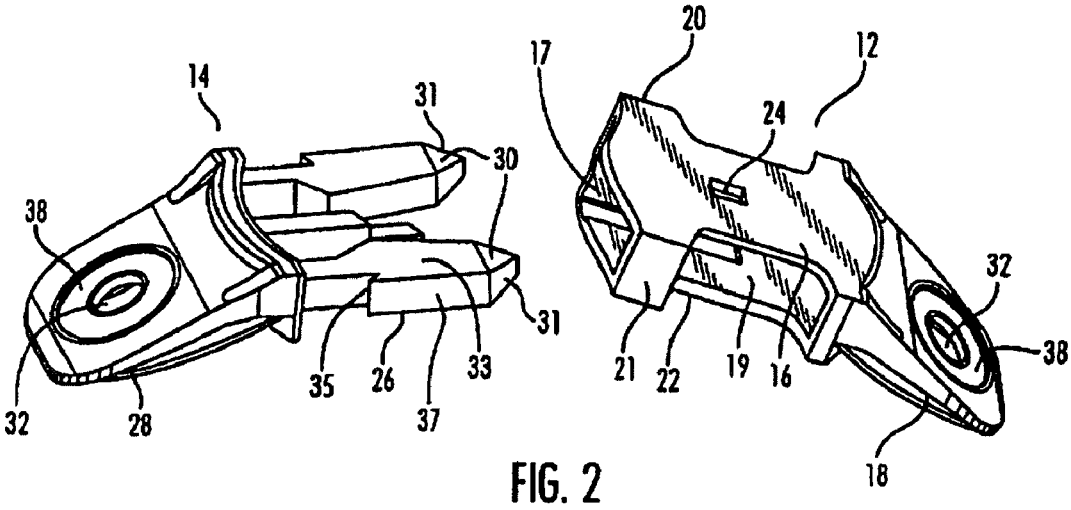
FIG. 2 is a top perspective view of a first connecting member and a second connecting member of the embodiment of FIG. 11*n* the unlocked or open position.

FIGS. 1*a* and 1*b* depict an exemplary embodiment of a latching mechanism. The latching mechanism 10 shown in FIG. 1*a* includes a first connecting member 12 and a second connecting member 14, wherein the first connecting member 12 and the second connecting member 14 are capable of mating, or interlocking, such that the latching mechanism 10 resides in a closed position. FIGS. 1*a* and 1*b* depict top and bottom perspective views of an embodiment of a latching mechanism in the locked, or closed, position. FIG. 2 depicts the first connecting member 12 and the second connecting member 14 in an unlocked position. The latching mechanism 10 is generally made from hard plastics, but other sturdy materials, such as, but not limited to, Plexiglas®, or soft alloys, such as for example, aluminum are also suitable.

As shown in FIG. 2, the first connecting member 12 includes a hollow receiving head 16 and a first mounting arm 18, wherein the first mounting arm 18 is adjacent to and extends from the head 16. The first mounting arm 18 resides at an angle relative to the horizontal plane of the receiving head 16. The head 16 and the first mounting arm 18 are formed as a single, unitary piece. In other embodiments, the head 16 and the first mounting arm 18 are formed as separate pieces, wherein the first mounting arm 18 is coupled to the head 16 by, for example, glue or soldering.

The head 16 of the first connecting member 12 has an open end 17, side openings 19, a top side 20 and a bottom side 22, wherein the top side 20 includes an aperture 24. In other embodiments, the top side 20 of the head 16 does not include the aperture 24, but rather, is a solid surface.

The second connecting member 14 includes a tongue member 26 and a second mounting arm 28, wherein the second mounting arm 28 is adjacent to and extends from the tongue 26. The second mounting arm 28 resides at an angle relative to the horizontal plane of the tongue 26. The tongue 26 and the second mounting arm 28 are formed as a single, unitary piece. In other embodiments, the tongue 26 and the second mounting arm 28 are formed as separate elements, wherein the second mounting arm 28 is coupled to the tongue 26 by, for example, glue or soldering.

In the exemplary embodiments illustrated in FIGS. 1*a*-4*b*, the tongue 26 of the second connecting member 14 is configured to fit through the open end 17 of the head 16. The tongue 26 includes a pair of prong members 30, wherein each prong member 30 has a tapered end 31 and a widened end 33. The pair of prong members 30 is received in the open end 17 of the hollow receiving head 16. As the tongue enters the open end 17 of the receiving head 16, the prong members 30 flex toward each other. The tapered ends 31 of the prong members 30 abut side walls 21 of the receiving head 16 and cause the prong members 30 to resiliently flex toward each other. Once the tongue 26 is sufficiently within the receiving head 16, the widened ends 33 of the prong members 30 align with the side openings 19 of the receiving head 16, thus allowing the prong members 30 to spring back away from each other by their own resiliency. The widened ends 33 of the arms include angled surfaces 35 defining a catch or hook for abutting the edge of the side wall 21 to inhibit movement of the tongue out of the head 16. The widened ends 33 of the prong members 30 define side surfaces which can be pressed toward each other, e.g., by the user's thumb and forefinger, to flex the prong members 30 toward each other and release the catch or hook 35.

Figure 3:
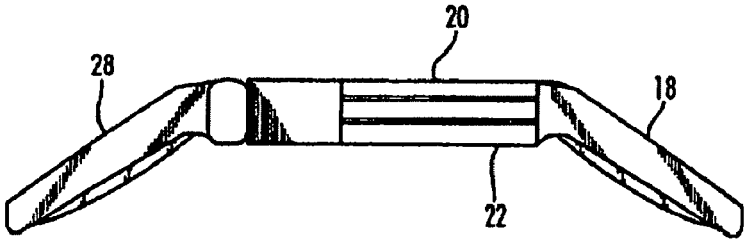
FIG. 3 Prior art
FIG. 3 is a lateral view of the embodiment of FIG. 1, wherein the latching element is in a locked, or closed, position.

The receipt of the tongue 26 into the receiving head 16 releasably couples the first connecting member 12 and the second connecting member 14. When the tongue 26 is releasably coupled to the head 16, the latching mechanism 10 is in the closed or locked position, as shown in FIGS. 1*a* and 3. In other embodiments, the tongue member 26 has a single prong element 30 which is received by the hollow receiving head 16.

Figure 4A:
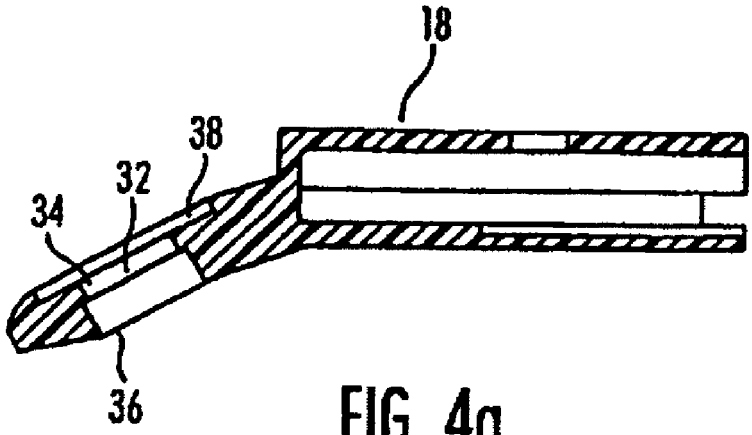
FIG. 4*a* is a lateral cross sectional view of a first connecting member.
Figure 4B:
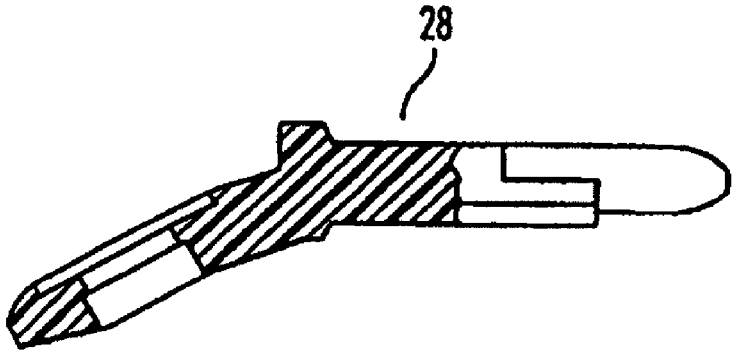
FIG. 4b Prior art
FIG. 4*b* is a lateral cross sectional view of a second connecting member.

FIGS. 4*a* and 4*b* depict cross sections of the first mounting arm 18 and the second mounting arm 28, respectively. As shown in FIGS. 4*a* and 4*b*, the first mounting arm 18 and the second mounting arm 28 include a circular recess 38 of a first diameter and an aperture 32 of a second, smaller diameter centered in the circular recess 38 capable of receiving a securing mechanism, for example, a securing element and a corresponding locking element as described below. The aperture 32 includes a first end 34 and a second end 36. The recess 38 is disposed adjacent the first end 34 of the aperture 32. As shown in FIGS. 4*a* and 4*b*, the cross-sectional diameter of the aperture 38 is larger than the cross-sectional diameter of the first end 34 or the diameter of the second end 36 of the aperture 32. The diameter of the recess 38 can be large enough to seat for example, the head of a screw, binder post, or other securing element. In other embodiments, the aperture 32 does not include a recess 38.

Figure 7:
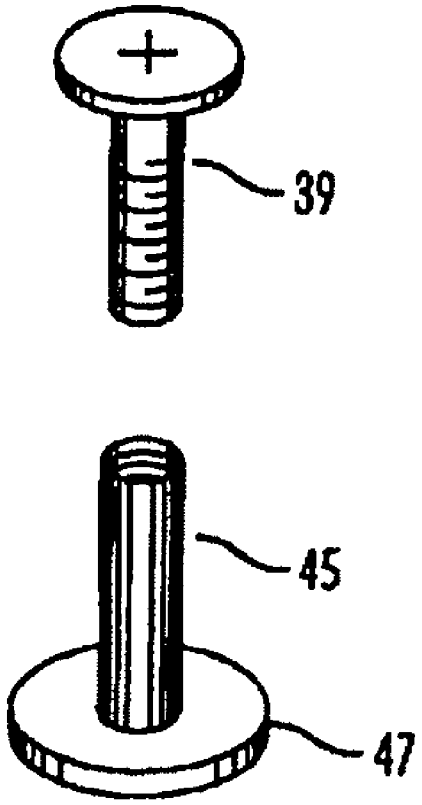
FIG. 7 Prior art
FIG. 7 depicts an embodiment of a securing element and a locking element.

In some embodiments, the securing element 39 is a threaded member, such as, but not limited, to a screw or binder post, and the locking element is a hollow threaded receptacle 45 having a nearly flat head or flange 47 at one end (see FIG. 7). In other embodiments, the securing element 39 can be any element suitable for securing the mounting arm to the foot apparel, such as, but not limited to, rivets. The receptacle 45 is capable of receiving the securing element 39 such that the securing element 39 and the receptacle 45 are coupled. However, further embodiments employ any suitable type of securing mechanisms capable of coupling the arm to the foot apparel. The securing mechanism can be easily uncoupled by the user such that the latching mechanism 10 can be interchanged with other foot apparel. The securing element 39 and locking element can be made of any rigid material such as brass, aluminum, steel, nylon or plastic.

The aperture 32 is capable of communicating with the eyelet of the user's foot apparel. The aperture is generally circular in shape, but other shapes that can accommodate a securing mechanism are also suitable.

Figure 9:
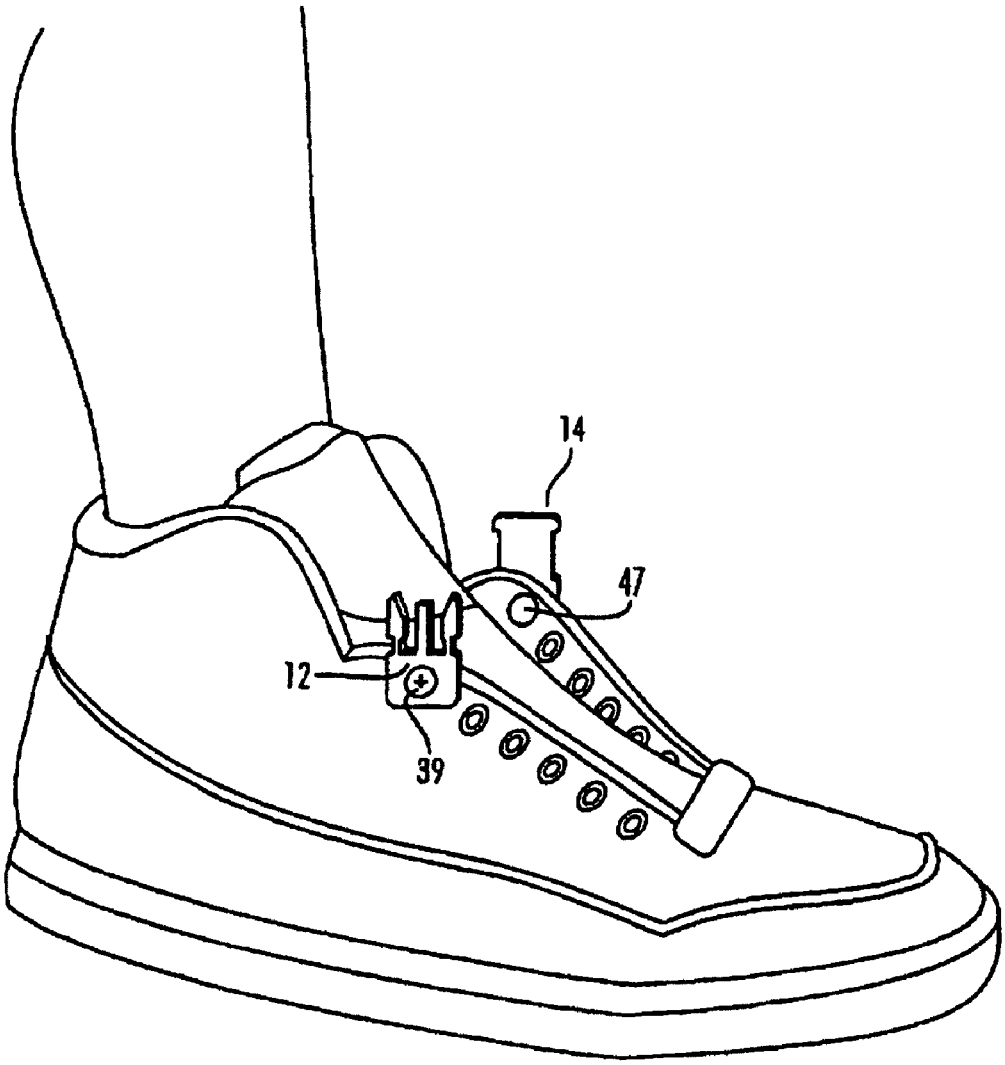
FIG. 9 Prior art
FIG. 9 depicts a first arm and a second arm secured to the upper flaps of foot apparel.

The aperture 32 is large enough to accommodate the diameter of the hollow threaded receptacle 45 as shown in FIG. 7. The hollow threaded receptacle is pushed through the underside of the eyelet and the aperture 32 such that the flange 47 is nearly flush with the eyelet. (See FIG. 9) When locked in place, the head of the securing element 39, such as a screw, resides in the recess 38 and the flange 47 of the locking element 45 is nearer the leading edge of the body of the screw, i.e., the portion furthest from the head of the screw. Due to the flange 47 being relatively flush with the underside of the eyelet, the securing element 39 does not press against the user's foot and cause discomfort.

As shown in FIG. 3, the first mounting arm 18 and the second mounting arm 28 extend at an angle to the horizontal plane of the head 16 and the tongue 26, respectively. The first mounting arm 18 and second 28 arm are rigid in structure such that locking the latching mechanism 10 does not substantially affect the angle of the arms 18,28 relative to the head 16 and tongue 26. Due to the rigidity of the arms 18, 28, when the latching mechanism 10 is secured to the foot apparel through the eyelets, the latching mechanism 10 does not rest against the user's foot in either the open or closed position. Instead, the arms 18, 28 substantially contour the latching mechanism to the shape of the user's foot slightly above the foot apparel.

Figure 5A:
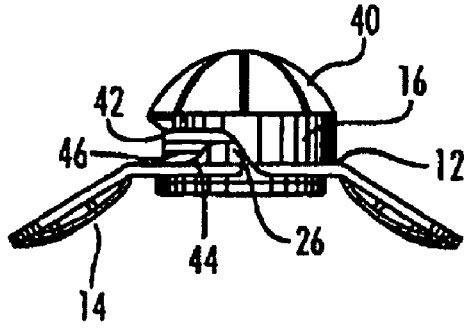
FIGS. 5*a* and 5*b* are lateral views of another embodiment, including a button, in a locked position.
Figure 5B:
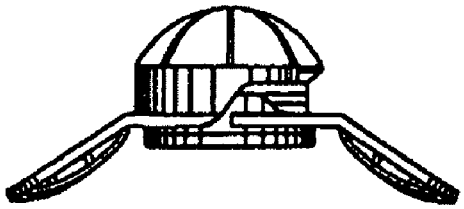
Figure 5C:
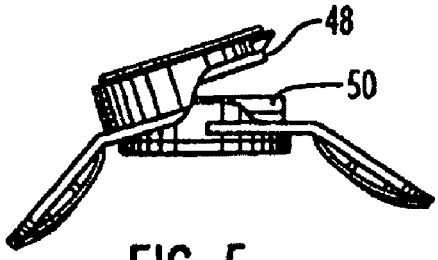
FIG. 5c Prior art
FIG. 5*c* is a lateral view of the embodiment depicted in FIG. 5*a* in an open position.
Figure 5D:
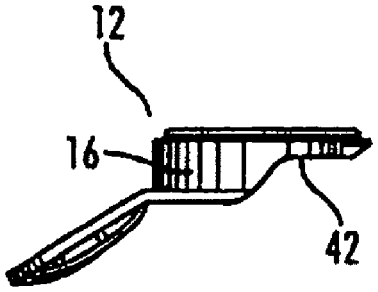
FIG. 5*d* is a lateral view of the first connecting member of the embodiment depicted in FIG. 5*a* without the button.
Figure 5E:
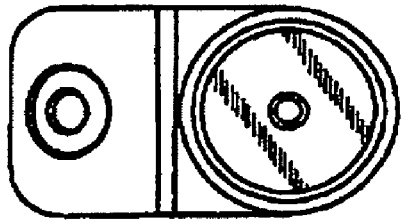
FIG. 5*e* is a top view of the first connecting member in FIG. 5*d*.
Figure 5F:
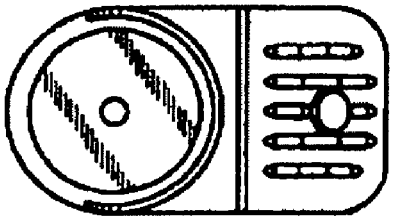
FIG. 5*f* is a bottom view of the first connecting member in FIG. 5*d*.
Figure 5G:
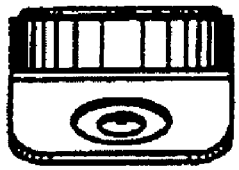
FIG. 5g Prior art
FIG. 5*g* is a frontal perspective of the first connecting member in FIG. 5*d*.
Figure 5H:
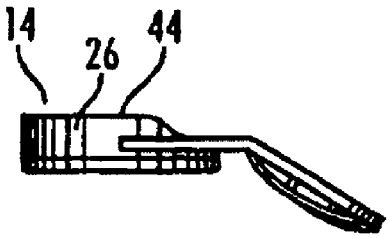
FIG. 5*h* is a lateral view of the second connecting member of the embodiment depicted in FIG. 5*a* without the button.
Figure 5I:
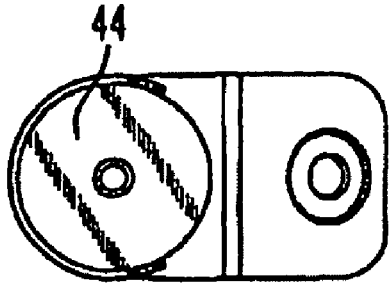
FIG. 5*i* is a top view of the second connecting member in FIG. 5*h*.
Figure 5J:
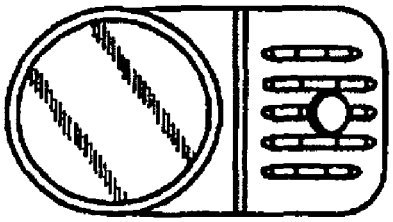
FIG. 5*j* is a bottom view of the second connecting member in FIG. 5*h*.
Figure 5K:
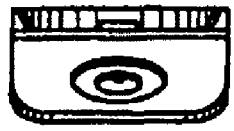
FIG. 5k Prior art
FIG. 5*k* is a frontal perspective of the second connecting member in FIG. 5*h*.
Figure 5L:
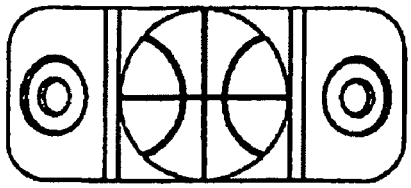
FIGS. 5*l* and 5*m* are top views of the embodiment depicted in FIG. 5*a*.
Figure 5M:
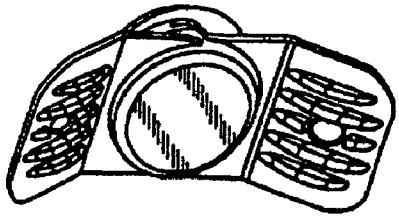
Figure 5N:
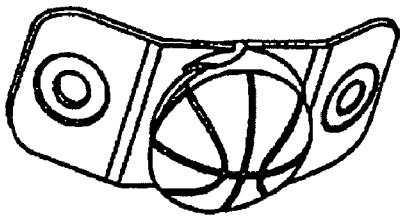
FIG. 5*n* is a bottom view of the embodiment depicted in FIG. 5*a*.
Figure 5O:
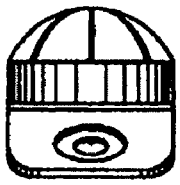
FIG. 5o Prior art
FIG. 5*o* is a frontal perspective view of the embodiment depicted in FIG. 5*a*.

FIGS. 5*a*-5*o* depict another embodiment of the latching mechanism 10, including a button element 40. The embodiment shown in FIG. 5*a* includes a first connecting member 12 having a first receiving platform 42, a second connecting member 14 having a second receiving platform 44 and a fastener element 46. In this embodiment, the tongue 26 of the second connecting member 14 is disk shaped, although other shapes that will fit within the head 16 of the first connecting member 12 are also suitable.

Figure 8:
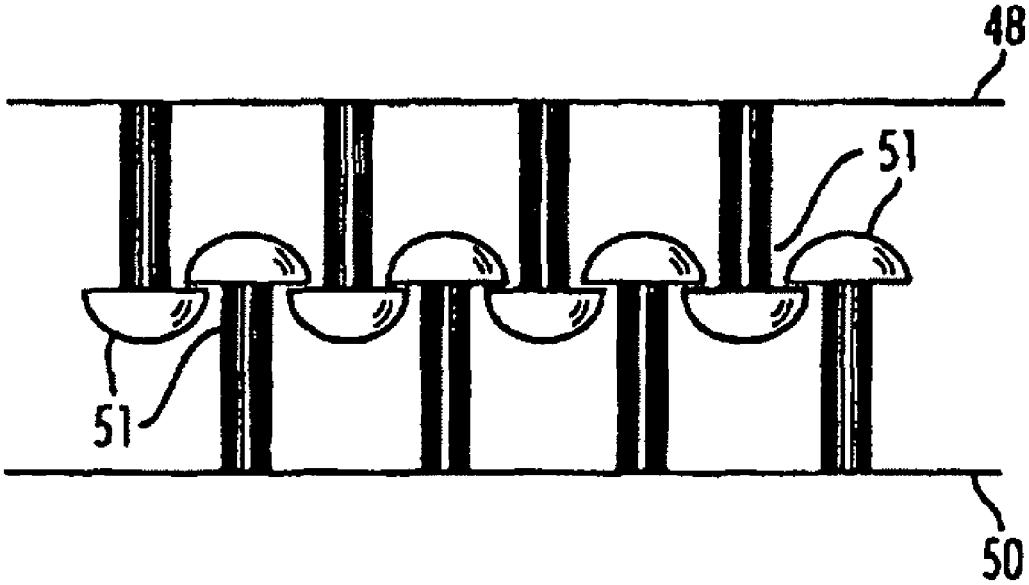
FIG. 8 Prior art
FIG. 8 depicts a mushroom-shaped stem fastener mechanism.

An embodiment of a fastener element 46 is shown in FIG. 8. In this embodiment, the fastener element 46 further includes a first portion 48 and a second portion 50, wherein the first portion 48 and the second portion 50 each include a plurality of mushroom-shaped stems 51. The mushroom-shaped stems 51 provide improved tensile strength and holding power in comparison to the well known hook and loop fasteners, although a hook and look fastener is used in other embodiments. The first portion 48 and the second portion 50 are capable of being coupled to each other and separated from each other, repeatedly. To couple the first portion 48 and the second portion 50, the mushroom shaped stems on each portion interlock with each other. The fastener element 46 is made from flexible material, such as, but not limited to, rubber or plastic. In one embodiment, the fastener element 46 is a Dual Lock Reclosable Fastener made by Minnesota Mining & Manufacturing (3M).

The first portion 48 of the fastener element 46 is disposed on the first receiving platform 42 of the first connecting member 12 and the second portion 50 is disposed on the second receiving platform 44 of the second connecting member 14. When the first portion 48 couples with the second portion 50, the first connecting member 12 and the second connecting member 14 are thereby coupled, and the latching mechanism 10 resides in a closed position. (See FIG. 5*a*) The first portion 48 and second portion 50 can be disposed on the first receiving platform 42 and the second receiving platform 44 respectively, by any means, including, but not limited to, an adhesive backing, sewing, stapling or ultrasonic bonding. Alternatively, the first portion 48 and the second portion 50 can be formed integrally with the first receiving platform 42 and the second receiving platform 44, respectively.

FIG. 5*c* depicts this embodiment in an open position. As seen from the FIG., the first portion 48 and the second portion 50 are pulled away from each other such that the first connecting member 12 and the second connecting member 14 separate, and thereby open the latching mechanism 10.

Figure 6A:
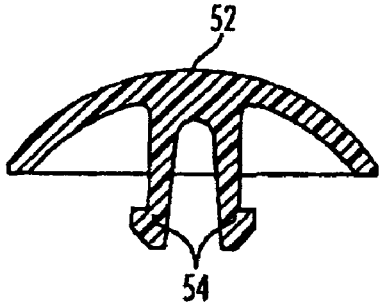
FIG. 6*a* is a cross sectional side view of an embodiment of a button element having a plurality of stems or guides.
Figure 6B:
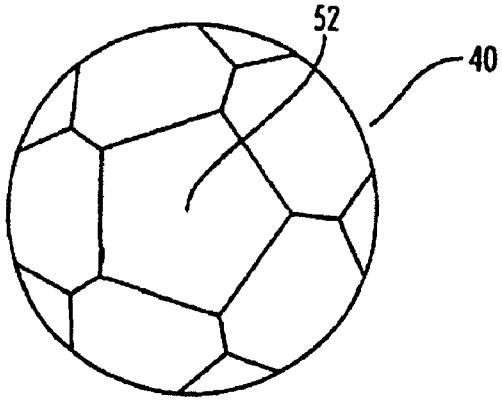
FIG. 6*b* is a top view of an embodiment of the button element of FIG. 6*a*.
Figure 6C:
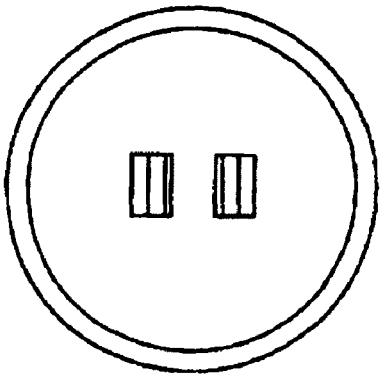
FIG. 6c Prior art
FIG. 6*c* is a bottom view of an embodiment of the button element of FIG. 6*a*.
Figure 6D:
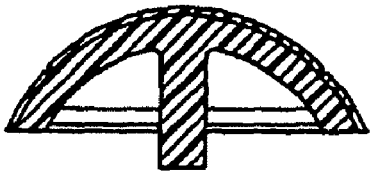
FIG. 6*d* is a cross sectional side view of another embodiment of a button element having a single stem or guide.
Figure 6E:
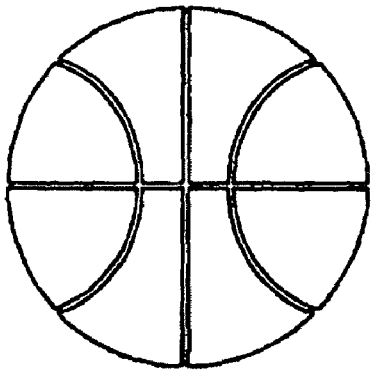
FIG. 6*e* is a top view of an embodiment of the button element of FIG. 6*d*.
Figure 6F:
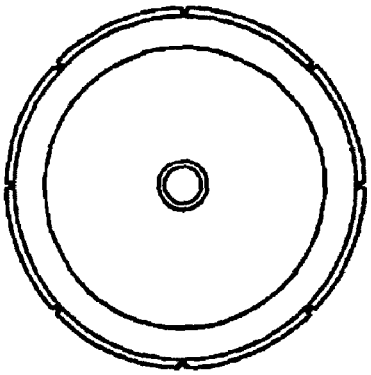
FIG. 6f Prior art
FIG. 6*f* is a bottom view of an embodiment of the button element of FIG. 6*d*.

FIG. 6*a* depicts a cross section of a button member 40 having a face 52, a bottom 53 and a plurality of stems or guides 54. In other embodiments, there is a single stem or guide 54. FIG. 6*b* depicts a top view of the face 52 of the button 40. The face 52 of the button 40 is capable of displaying designs, logos or other advertising indicia, such as, but not limited to, sports or product references. A plastic or paper member having a printed logo or design is applied to the face 52 of the button 40 by any securing means, such as, for example, glue or tape. In other embodiments, the plastic or paper member having a logo is not attached to the face 52 of the button 40, but rather, the logo is for example, etched, blazed or glued onto the face 52 of the button 40 or the head 16 itself. The button face 52 is circular in shape, but other shapes, such as, but not limited to, shapes corresponding to footballs, baseballs, and golf balls, are also suitable.

The stem or guide 54 of the button 40 is received by the aperture 24 in the head 16 of the first connecting member 12 such that the face 52 of the button 40 is visible from the top 20 of the head 16. In other embodiments, a coupling means, such as but not limited to, adhesive, is disposed on the bottom 53 of the button 40. In these embodiments, when the guide 54 is received by the aperture 24, the adhesive couples the button 40 to the head 16. Logos or advertisements that are placed on the face 52 of the button 40 can then be displayed.

Figure 6G:
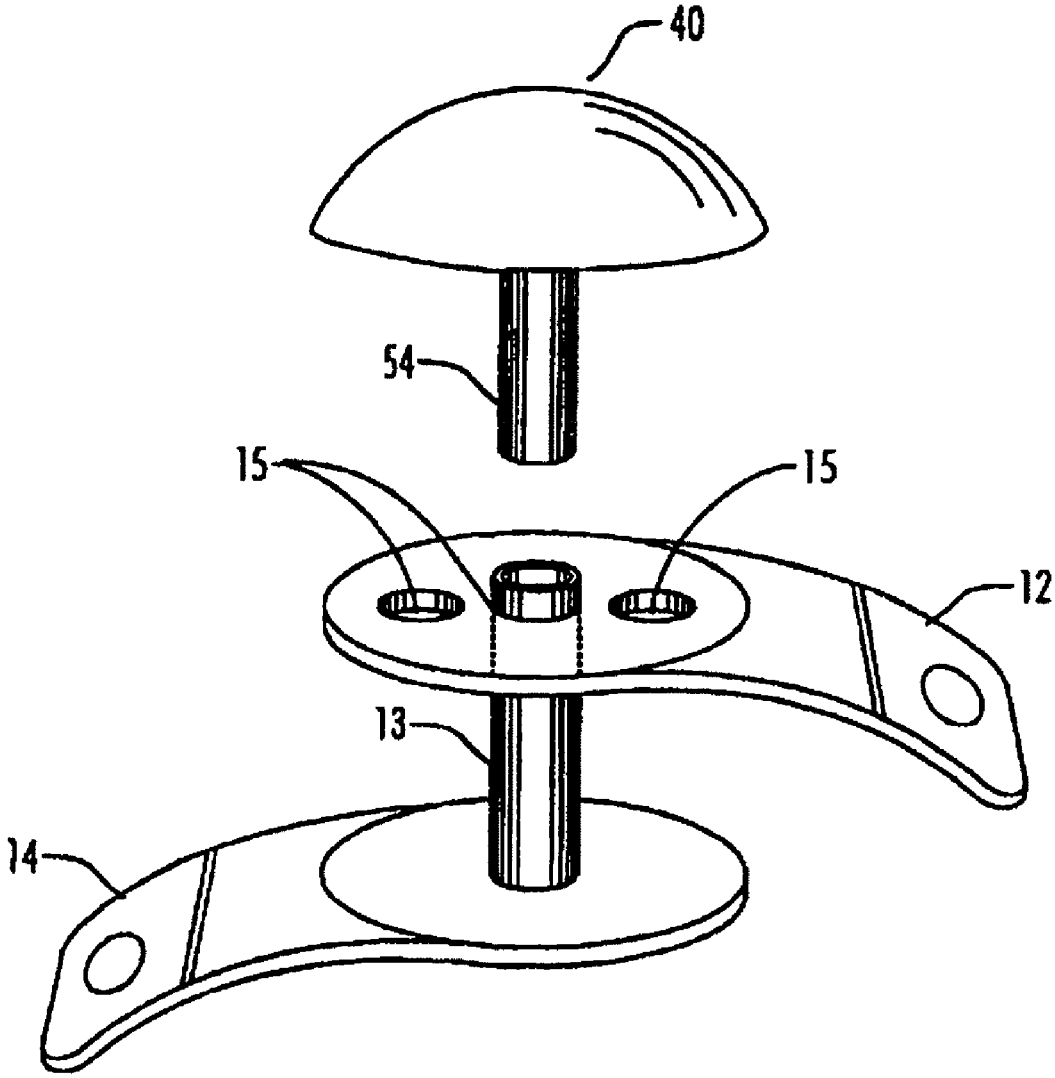
FIG. 6g Prior art
FIG. 6*g* is a side view of another embodiment wherein the button element couples to the first connecting member and the second connecting member such that the latching mechanism is in the closed position.

In other embodiments, the guide 54 is a threaded member such that the button 40 screws or threads into the aperture 24 in the head 16 of the first connecting member 12. In further embodiments, the button 40 does not include a guide 54. Rather, adhesive or any other suitable coupling means is disposed on the bottom 53 of the button 40 such that the button 40 is capable of coupling to the head 16 of the button 40. In still other embodiments, the button 40 is capable of coupling to the head 16 of the first connecting member 12 and the tongue 26 of the second connecting member 14 such that the button 40 couples the first connecting member 12 and the second connecting member 14 to close the latching mechanism 10. As shown in FIG. 6*g*, in these embodiments, the second connecting member further includes a threaded tubular receptacle 13 and the first connecting member 12 further includes a plurality of apertures 15. The threaded tubular receptacle 13 is received by at least one of the apertures 15 in the first connecting member 12. The guide 54 of the button 40 is capable of coupling with the threaded tubular receptacle 13 such that the first connecting member 12 and the second connecting member 14 are coupled.

In operation, the mounting arm 18 of the first connecting member 12 and the mounting arm 28 of the second connecting member 14 are attached to an eyelet of the user's foot apparel such that the arms 18,28 reside on top of the outer flaps 56 of the foot apparel. (See FIG. 9) A securing element, such as, but not limited to, a screw, rivet or binding post is driven through the first end 34 of the aperture 32 and then through the eyelet of the foot apparel. The locking mechanism 45 is then driven through the underside of the upper flap of the foot apparel such that the flange resides relatively flush with the upper flap. The locking mechanism 45 is then threaded onto the screw. Once both arms 18, 28 are coupled to the eyelets of the foot apparel, the first connecting element 12 and the second connecting element 14 are connected such that the shoe closes.

Figure 10:
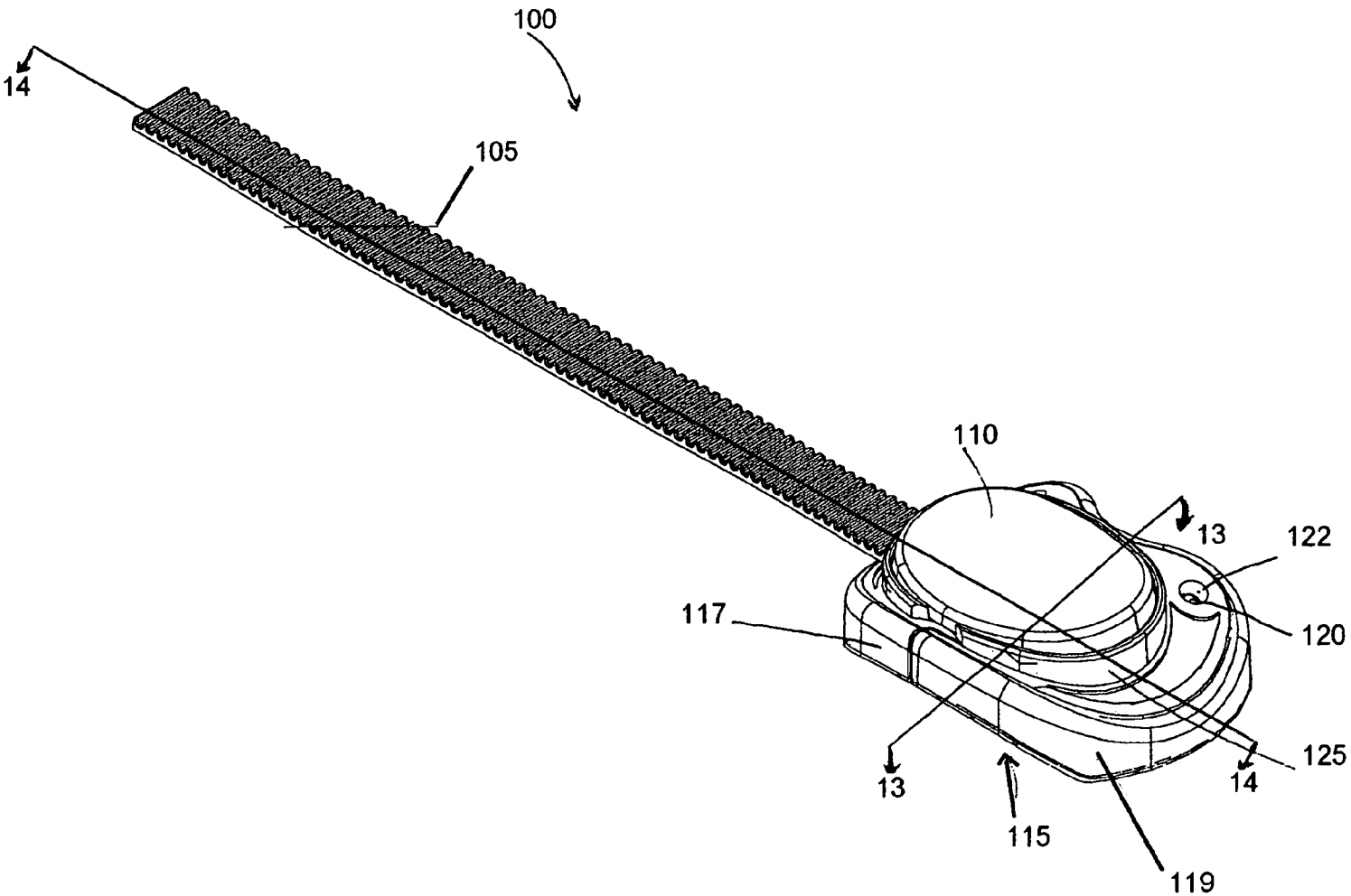
FIG. 10 depicts an assembled, perspective view of the buckle.

FIG. 10 depicts another embodiment of a latching mechanism which is adjustable to fit a variety of footwear sizes. The buckle system 100 includes a base 115, button 125, dome 110 and at least two rivets 120. The buckle system 100 is attached to the user's footwear by way of the eyelets, for example, eyelets near the top of the user's instep nearest the ankle. The buckle system 100 is laterally adjustable across an axis perpendicular to the instep.

Figure 11:
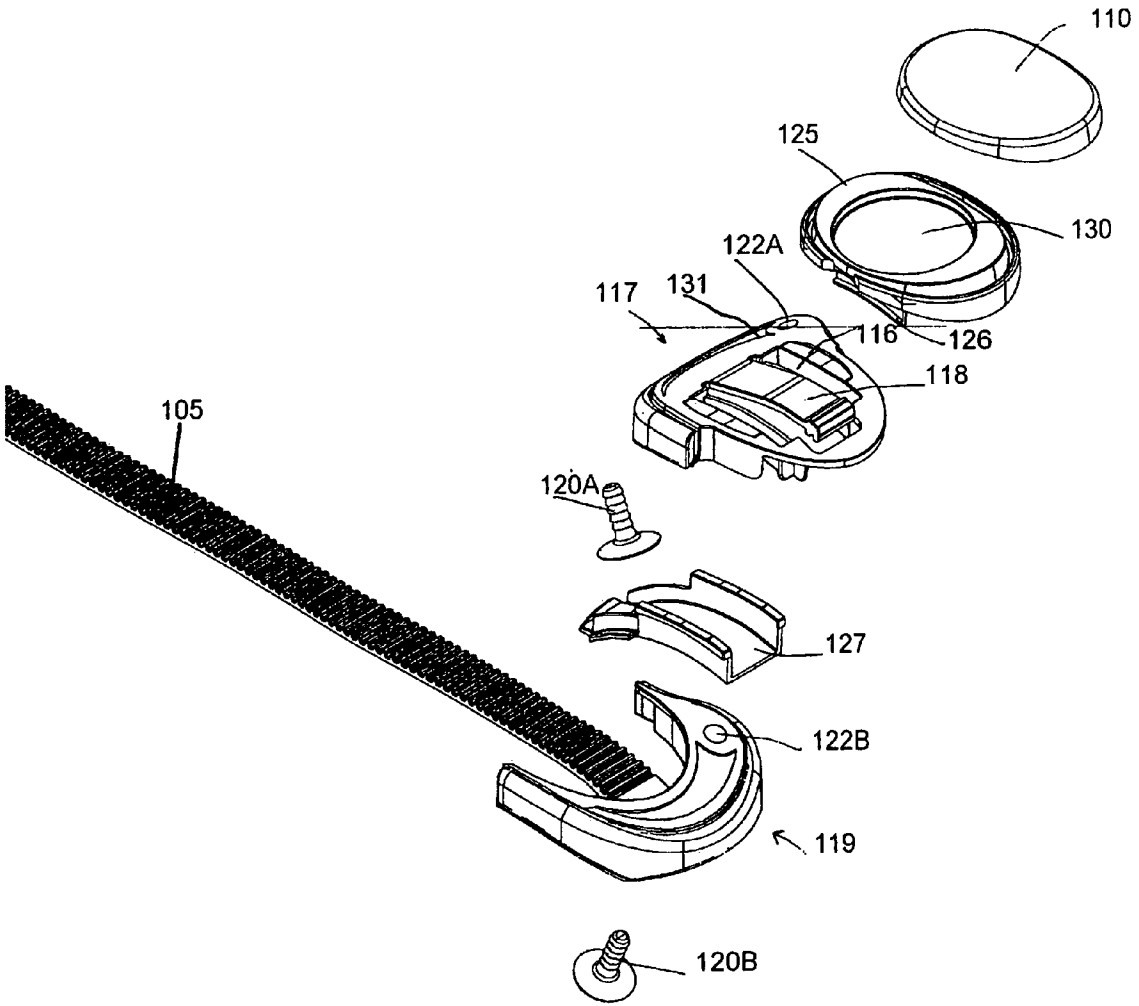
FIG. 11 depicts an exploded view of the buckle shown in FIG. 10.
Figure 12:
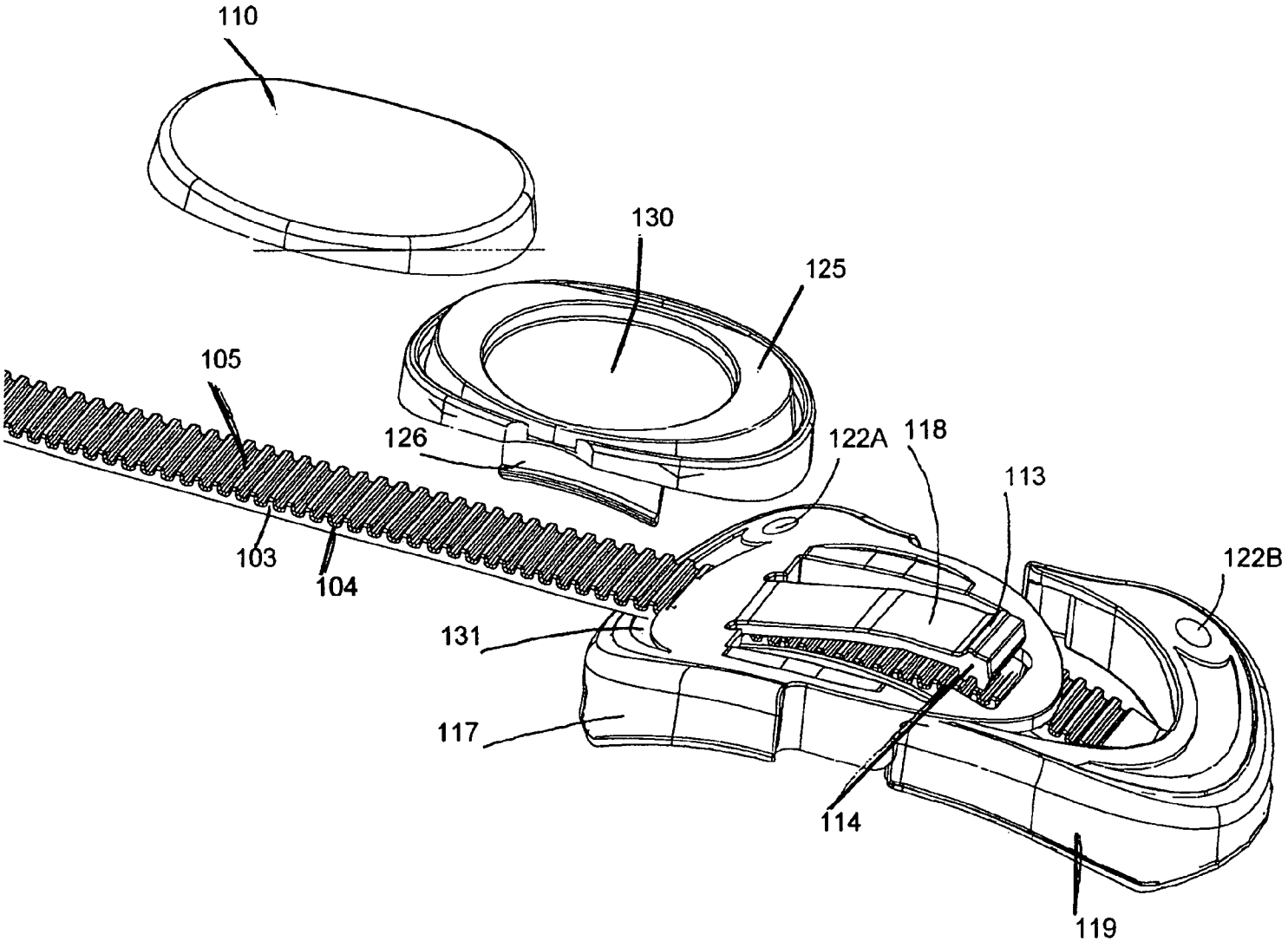
FIG. 12 depicts a partially exploded view of the buckle shown in FIG. 10.

As shown in FIG. 11, the base includes a male portion 119 and a female portion 117. The male portion 119 of the base includes a flexible belt 105, wherein the belt 105 is attached at one end to the base and is free at the opposite end. The female portion 117 of the base includes an attachment member and a slot 131. The attachment member can be a plank 118. The slot 131 is located behind the fulcrum of the plank 118. The width between the male portion 119 and the female portion 117 are laterally adjustable by virtue of the belt 105. As best shown in FIG. 12, the belt 105 can be fed under the plank 118 and through the slot 131 of the female portion 117 thereby connecting the male portion 119 to the female portion 117. As the male portion 119 approaches the female portion 117, the width between the opposing eyelets of the instep of the user's footwear narrows. Upon obtaining an optimum width between the two portions of the base depending upon the user's comfort and desired fit, the excess portion of the belt 105 can be removed such as by cutting. The shapes of the male and female portions 119,117 of the base are complementary such that when in close proximity to one another, the two portions give the appearance of a unitary base 115. The base 115 can be, but is not limited to, an oval shape. Further, the female portion 117 and the male portion 119 can be covered at least in part by an overmold (not shown) applied thereon, which can include a spongy or shock-absorbing material. The overmold can be colored or provided with graphical elements for aesthetic purposes.

As mentioned, the buckle system 100 also includes a button 125. As shown in FIG. 12, the button 125 includes on its upper surface a stage 130 and on its underneath surface ramp flanges 126. The button 125 is actuated to lock the position of the female portion 117 to the male portion 119. In an exemplary embodiment, the button 125 locks the plank 118 of the female portion 117 to the belt 105 of the male portion 119. The plank 118 is flexible and the floating portion biased upward such that it rises above the plane of the base 115. When pressure is applied to the upper surface of the plank 118, the floating portion bends downward toward the belt 105. The floating portion of the plank 118 opposite the fulcrum also includes a lip 113 on its upper surface and teeth 114 on its bottom surface.

Figure 13:
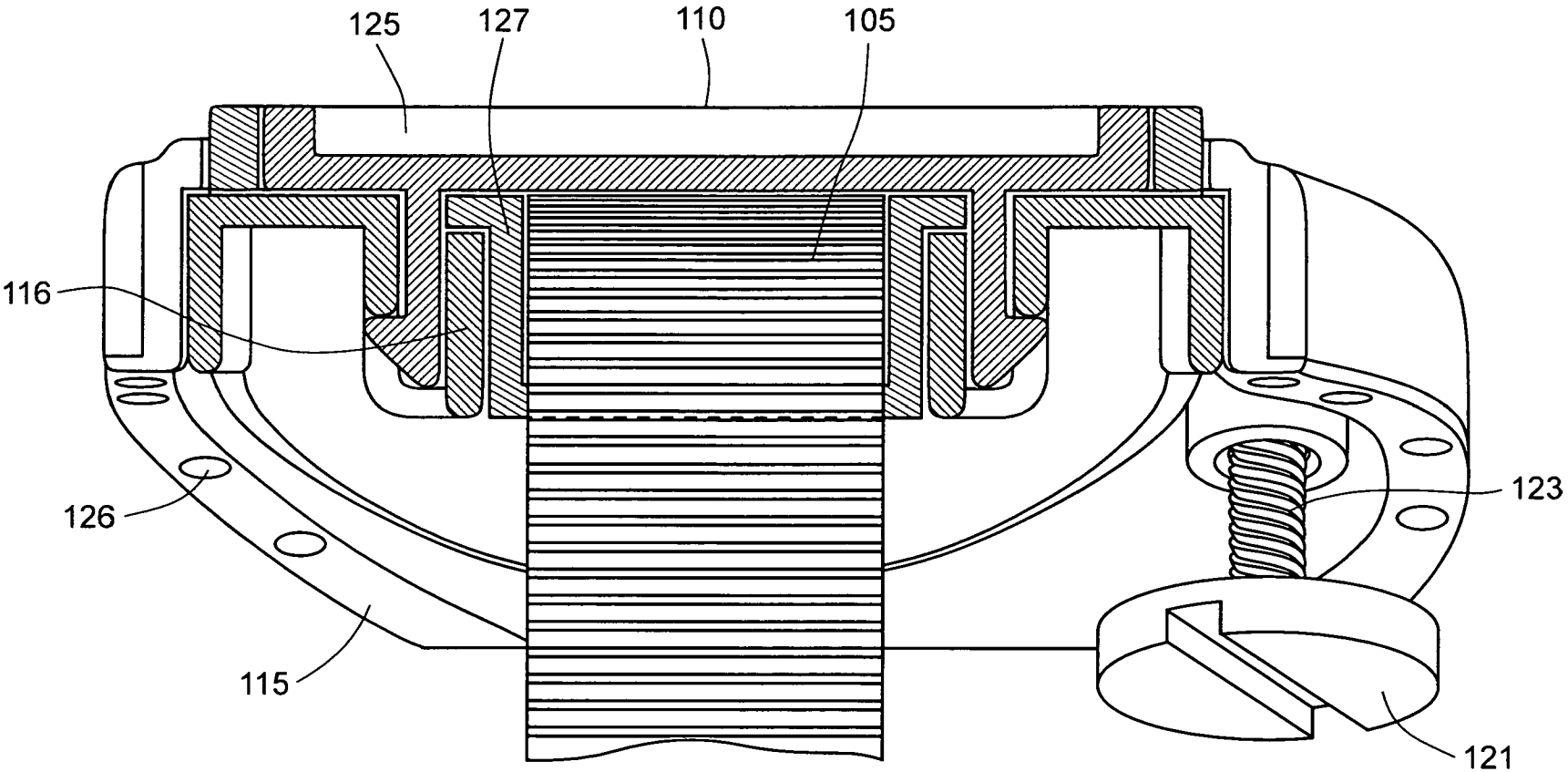
FIG. 13 depicts a cross-sectional view of the buckle shown in FIG. 10 along line 13-13.
Figure 14:
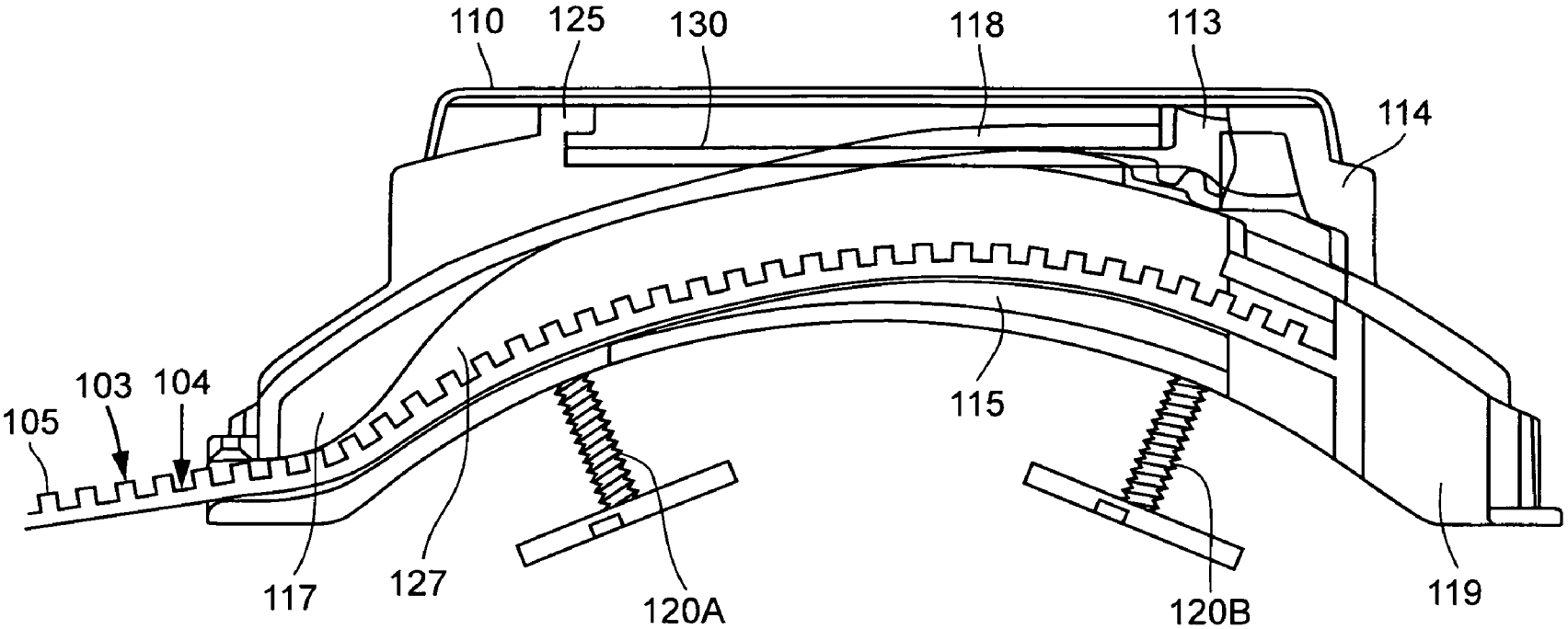
FIG. 14 depicts a cross-sectional view of the buckle shown in FIG. 10 along line 14-14.

Sliding the button 125 sideways away from the fulcrum of the plank 118 and toward the male portion 119 of the base 115 compresses the plank 118 downward. The teeth 114 of the plank 118 are configured to fit between the ridges 103 and within the clefts 104 of the belt 105 thereby engaging the belt 105 and preventing lateral movement of the male portion 119 away from the female portion 117 of the base 115. The female portion 117 of the base 115 can also comprise a belt guide 127 (see FIGS. 11 and 13). The belt guide 127 pushes back against the plank 118 upon compression from above thereby squeezing the belt 105 in between. This upward pressure further prevents the belt 105 from accidental dislodgement or unlocking. FIG. 14 depicts a cross-sectional view of the buckle system 100 and shows the relationship between the button 125, the plank 118 and the belt 105. Note, that the belt 105 shown in FIG. 14 is drawn such that it extends straight out away from the belt guide 127 providing more a simplistic view of the device. However, it should be appreciated that the belt 105 can lie flush with the belt guide 127.

With reference to FIG. 12, the ramp flanges 126 are located on the underneath surface of the button 125. The flanges 126 can be inserted through slots found on either side of the plank 118. The button 125 is attached to but remains laterally moveable within the female portion 117 of the base 115.

With reference to FIGS. 12 and 14, the button 125 can be moved laterally to lock the buckle system 100. In the ramp locking mechanism, the button 125 slides sideways away from the fulcrum toward the lip 113 of the plank 118. The button 125 and its flanges 126 follow the path of the ramp 116. The plank 118 is compressed downward and the teeth 114 engage with the clefts 104 of the belt 105. The underneath surface of the button 125 also can comprise a catch 135. Sliding the button 125 toward the lip 113 of the plank 118 forces the catch 135 to snap over the lip 113. This interaction between the catch 135 and the lip 113 prevents slippage of the button 125 back across the plank 118 thereby releasing the belt 105 and locks the button 125 into place. The female 117 and male 119 portions of the base 115 are thereby held at a fixed distance away from one another and width of the instep is determined.

Figure 15:
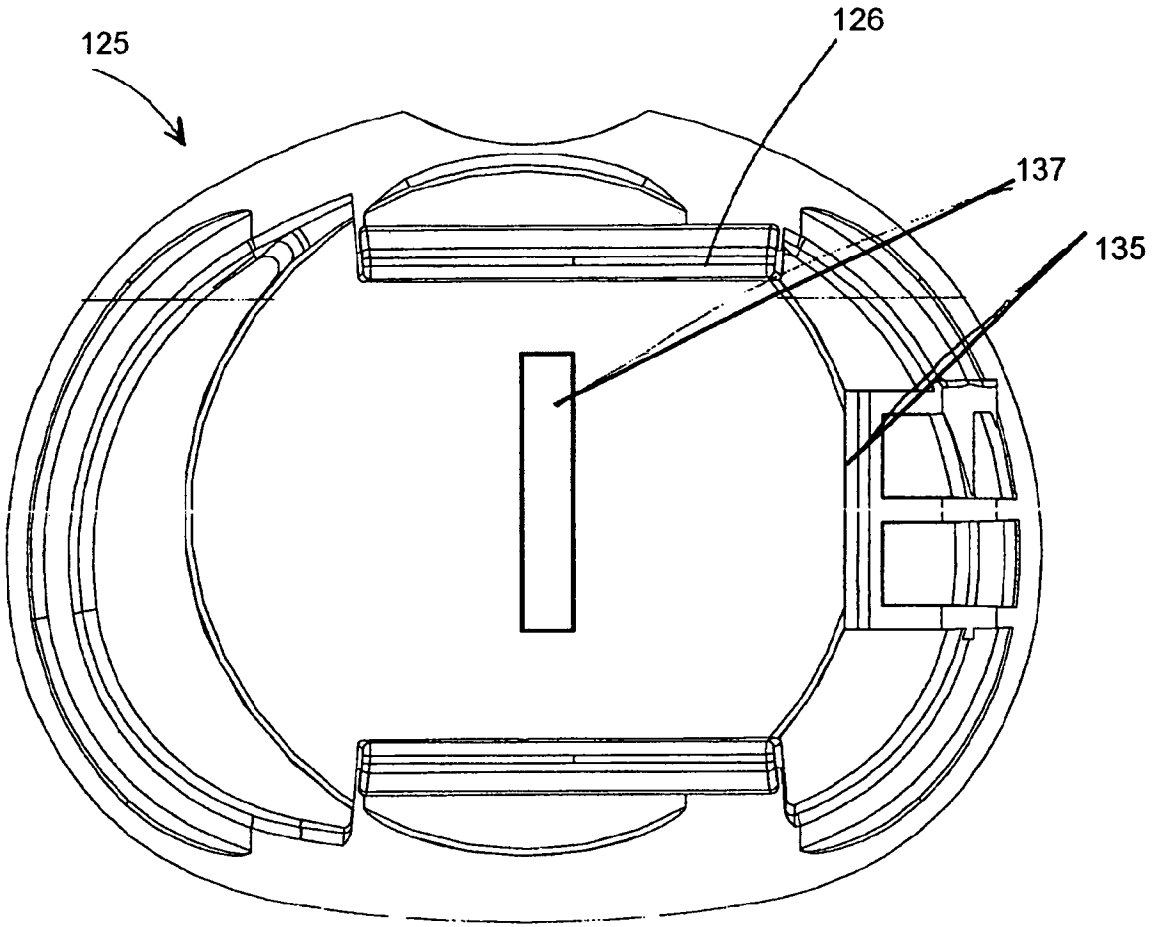
FIG. 15 depicts a bottom view of the button 125.
Figure 16:
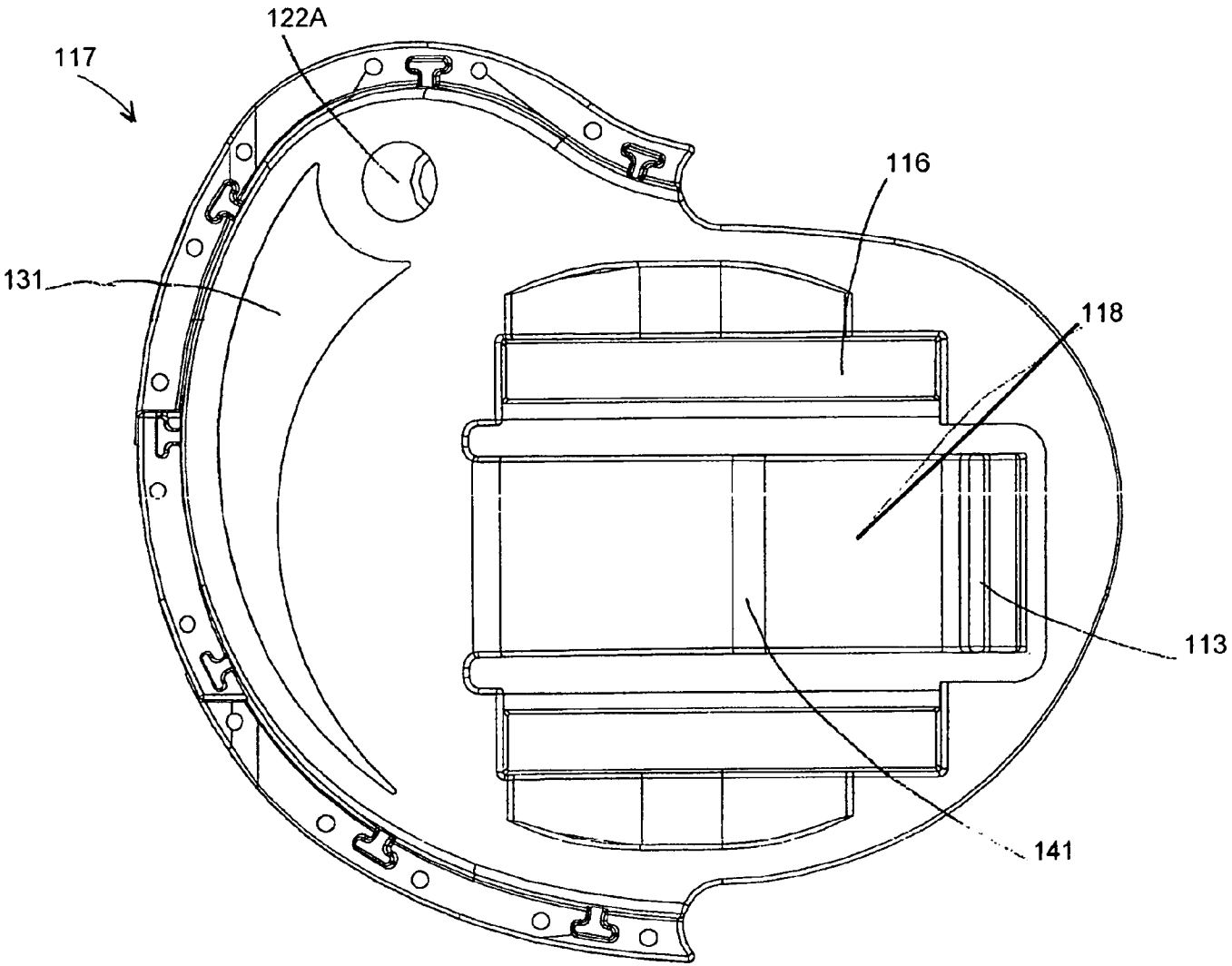
FIG. 16 depicts a top view of the female portion 117 of the base.

Another embodiment for locking the button 125 includes the tab-notch locking mechanism. With reference to FIGS. 15 and 16, the underneath surface of the button 125 can comprise a notch 137 which is sized to receive a tab 141 found on the upper surface of the plank 118. The user slides the button 125 sideways across the surface of the floating plank 118 thereby compressing the plank 118 downward towards the belt 105. The tab 141 snaps down into the notch 137 and locks the button 125 into place. The button 125 can also have a catch 135 located on its underneath surface, as described above, such that the catch 135 snaps over the lip 113 of the plank 118 further fixing the button in place and locking the teeth 114 onto the belt 105. Each locking mechanism can be used alone or in any combination with any other locking mechanism.

Figure 17A:
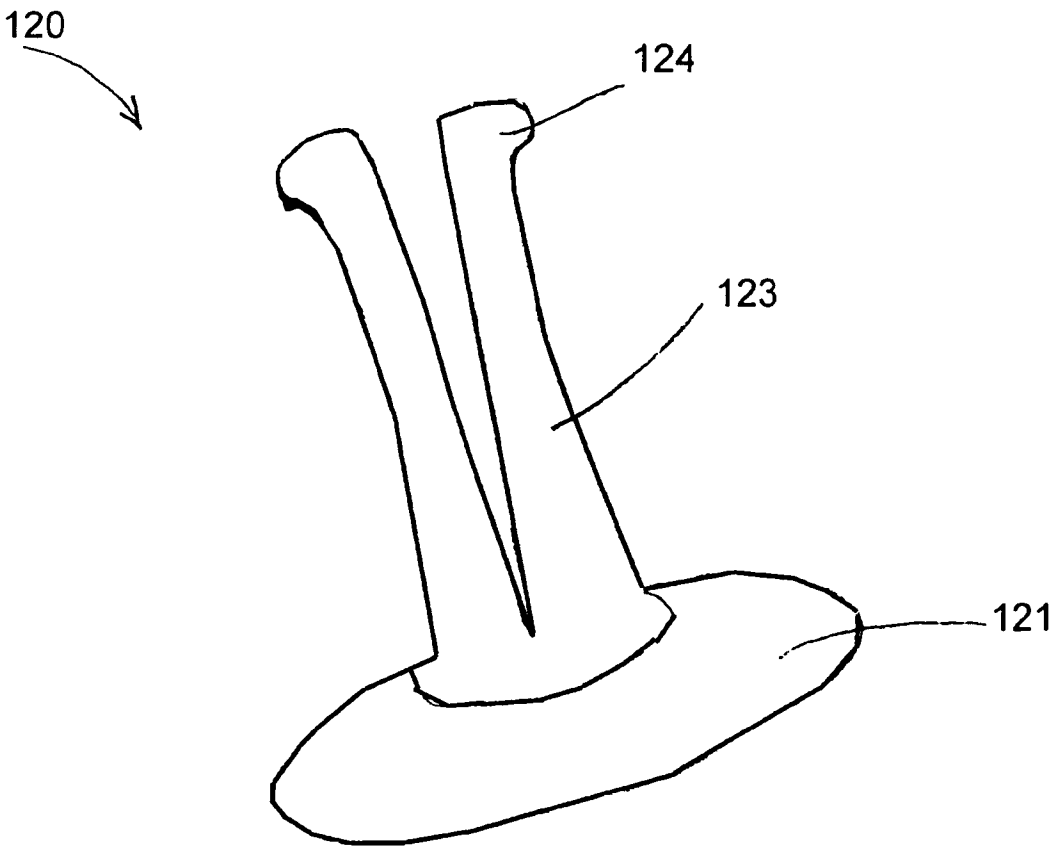
FIGS. 17*a* and 17*b* depict two exemplary embodiments of the post.
Figure 17B:
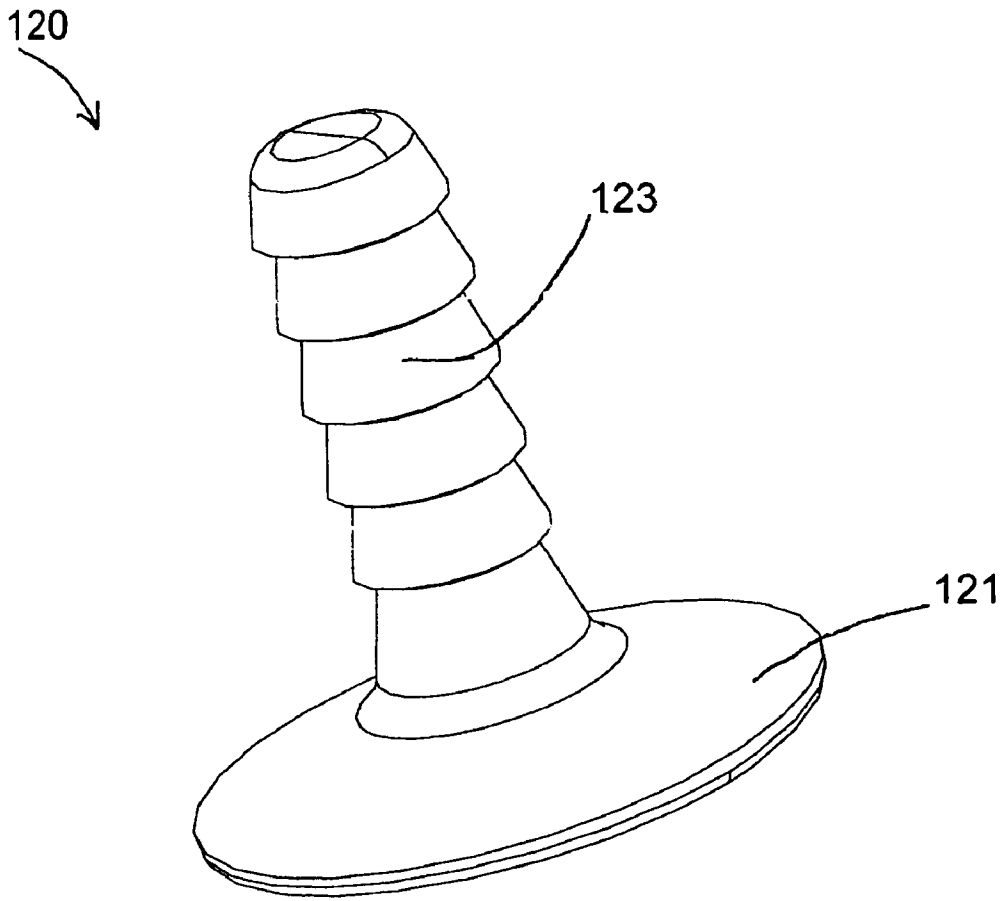

The buckle system 100 also includes at least two rivets 120. Each base portion can have at least one rivet 120. With reference to FIGS. 17A and 17B, the rivets 120 comprise a foot 121 and a post 123. As shown in FIGS. 10 and 12, the post 123 of the rivet 120 is inserted from the underneath side of the base 115 through an eyelet of the user's footwear and into an aperture 122 of the base 115. For example, rivet 120A is inserted through an eyelet and into the aperture 122A of the female portion 117 of the base 115. Rivet 120B is inserted through an opposing eyelet and into the aperture 122B of the male portion 117 of the base 115.

The rivets 120 lock into the apertures 122 fixing the buckle system 100 to the user's footwear. A foot 121 at the base of the rivet 120 prevents the rivet 120 from being pulled completely through the eyelet of the user's footwear. The foot 121 of the rivet 120 remains on the opposite side of the eyelet from the base 115 of the buckle system 100. Rivets 120 can vary in size. The aperture 122 is generally, but not necessarily, round in shape and matches the size of the eyelet in the footwear and the size of the rivets 120 being used with the buckle system 100.

The rivets 120 lock into the apertures 122 due to the configuration of the rivet post 123. FIGS. 17A and 17B show two exemplary embodiments of the post 123. The post 123 can be, for example, in a split-post configuration (FIG. 17A) or a flanged-post configuration (FIG. 17B). The split-post configuration relies, in part, upon wedging flared segments of the post into the aperture 122 of the base 115. To attach the base 115 to the user's footwear, the at least two post segments of the rivet 120 are squeezed together, passed through the eyelet and inserted into the underneath side of the base 115 through the aperture 122. The split post 123 is long enough such that the flange 124 of the post 123 reaches through the aperture 122 to the upper surface of the base 115. As described above, the foot 121 of the rivet 120 prevents the rivet 120 from being pulled completely through the eyelet. Similarly, the flange 124 of the rivet 120 prevents the rivet 120 from being pulled back through the aperture 122. FIG. 17B depicts a flanged-post rivet. The flanged-post rivet works in a similar manner as the split-post rivet in that it relies upon flanges of the post 123 to lock the rivet 120 inside the aperture 122 of the base 115. It does not, however, have the added protection of the flared post segments wedging the rivet 120 into the aperture 122. It should be appreciated that the mechanism for securing the buckle to footwear can interchangeably include any of those mechanisms disclosed herein, including, but not limited to, a rivet, screw, binder post, or other securing element.

The buckle system 100 also includes a dome 110. As shown in FIGS. 10 and 11, the dome 110 sits atop the button 125 and covers the stage 130. The dome 110 can include one or more tabs that are sized to latch against a corresponding slots in the button 125. Alternatively, the button 125 can include a groove or channel, into which the dome can be slid and secured into position.

The stage 130 is a recessed area located on the upper surface of the button 125 and is configured for displaying designs, logos or other advertising indicia, such as, but not limited to, sports or product references. The stage 130 and its dome 110 cover can also host small items such as candy, key(s), coin(s), photographs, or the like. The dome 110 can be opaque, translucent or transparent. The dome 110 can be removable. A plastic or paper member having a printed logo or design can be applied to the stage 130 of the button 125 by any securing means, such as, for example, glue or tape. The plastic or paper member having a logo also can be etched, blazed or glued onto the stage 130 of the button 125. The stage 130 and the dome 110 are generally oval in shape, but other shapes are considered.

The buckle system 100 can optionally include a light-emitting diode (LED). The LED can provide lighting in a downward direction along the instep such as towards the walking surface. The LED can also provide lighting in an upwards direction such as to backlight the dome 110. The LED can be activated upon locking the button 125 onto the belt 105.

Although embodiments of various methods and devices are described herein in detail with reference to certain versions, it should be appreciated that other versions, embodiments, methods of use, and combinations thereof are also possible. Therefore the spirit and scope of the latching mechanism should not be limited to the description of the embodiments contained herein.

What is claimed is:

1. A buckle for securing footwear to a user's foot, wherein the footwear includes an instep having a plurality of eyelets, the buckle comprising:

a base comprising a female portion and a male portion, the female portion comprising an attachment member and a slot, and the male portion comprising a flexible belt sized to fit within the slot of the female portion such that the female and male portions are laterally adjustable across an axis perpendicular to the instep;

a button configured to slideably actuate across the attachment member and compress the attachment member against the belt such that lateral movement of the female and male portions with respect to one another is prevented; and a plurality of rivets, at least one rivet being configured to insert through an eyelet into an aperture of the female portion and at least one rivet is configured to insert through an eyelet into an aperture of the male portion to attach the base to the footwear.

2. A buckle in accordance with claim 1, wherein the attachment member comprises a plank that is upwardly biased.

3. The buckle in accordance with claim 2, wherein the female portion further comprises a belt guide to provides upward resistance against the belt upon downward compression of the belt by the plank.

4. The buckle in accordance with claim 2, wherein the button further comprises a catch located on an underneath surface of the button.

5. The buckle in accordance with claim 4, wherein an upper surface of the plank comprises a lip that is engaged by the catch upon actuation of the button.

6. The buckle in accordance with claim 2, wherein the button further comprises a notch located on an underneath surface of the button.

7. The buckle in accordance with claim 6, wherein an upper surface of the plank further comprises a tab such that the tab snaps down into the notch upon actuation of the button.

8. The buckle in accordance with claim 1, wherein the button further comprises a stage on an upper surface of the button.

9. The buckle in accordance with claim 8, further comprising a dome to cover the stage of the button.

10. The buckle in accordance with claim 1, wherein the rivets each comprise a post and a foot, the post comprising a flange.

11. The buckle in accordance with claim 10, wherein the post is split into at least two flared segments.

12. The buckle in accordance with claim 1, further comprising a light-emitting diode.

13. The buckle in accordance with claim 12, wherein the light-emitting diode is activated upon actuation of the button.

14. A buckle for securing footwear to a user's foot, wherein the footwear includes an instep having a plurality of eyelets, the buckle comprising:

a base comprising an attachment member and a plurality of apertures, the base being sized and shaped for being laterally adjustable across an axis perpendicular to the instep, the base including a female portion and a male portion, the female portion comprising an attachment member and a slot, and the male portion comprising a flexible belt sized to fit within the slot of the female portion such that the female and male portions, and wherein the buckle further comprises a button configured to slideably actuate across the attachment member and compress the attachment member against the belt such that lateral movement of the female and male portions with respect to one another is prevented; and a plurality of rivets to attach the base to the footwear, at least one rivet being configured to insert through one of the plurality of apertures of the base and at least one other rivet being configured to insert through another of the plurality of apertures of the base to attach the base to the footwear.

15. A buckle in accordance with claim 14, further comprising a button configured to slideably actuate across the attachment member and compress the attachment member against the belt such that lateral movement of the female and male portions with respect to one another is prevented.

16. A buckle in accordance with claim 14, wherein at least one rivet is configured to insert through an eyelet into an aperture of the female portion, and at least one rivet is configured to insert through an eyelet into an aperture of the male portion, to attach the base to the footwear.

17. The buckle in accordance with claim 14, wherein the female portion further comprises a belt guide to provides upward resistance against the belt upon downward compression of the belt by the plank.

18. The buckle in accordance with claim 14, wherein the button further comprises:

a stage on an upper surface of the button; and a dome to cover the stage of the button.

19. A buckle for securing footwear to a user's foot, wherein the footwear includes an instep having a plurality of eyelets, the buckle comprising:

a base comprising a female portion and a male portion, the female portion comprising an attachment member and a slot, and the male portion comprising a flexible belt sized to fit within the slot of the female portion such that the female and male portions are laterally adjustable across an axis perpendicular to the instep;

a button configured to slideably actuate across the attachment member and compress the attachment member against the belt such that lateral movement of the female and male portions with respect to one another is prevented;

a plurality of rivets, at least one rivet being configured to insert through an eyelet into an aperture of the female portion and at least one rivet is configured to insert through an eyelet into an aperture of the male portion to attach the base to the footwear; and a light emitting diode in the base to provide lighting on a walking surface for the footwear.

* * * * *